United States Patent [19]

Jean et al.

[11] Patent Number: 4,841,728

[45] Date of Patent: Jun. 27, 1989

[54] STRAIGHT THROUGH TYPE MUFFLER FOR GENERATING THE EXHAUST FLOW FROM AN INTERNAL COMBUSTION ENGINE

[75] Inventors: Jyh-Jian Jean, No. 27, Hsi-Ning N. Rd.; Jyh-Perng Jean, both of Taipei, Taiwan

[73] Assignee: Jyh-Jian Jean, Taipei, Taiwan

[21] Appl. No.: 71,899

[22] Filed: Jul. 10, 1987

[51] Int. Cl.[4] ..... F02B 27/02; F01N 1/02; F01N 1/10

[52] U.S. Cl. ..... 60/312; 181/247; 181/250; 181/251; 181/252; 181/266; 181/268

[58] Field of Search ..... 181/247, 250, 251, 266, 181/268, 252; 60/312

[56] References Cited

U.S. PATENT DOCUMENTS

| | | | |
|---|---|---|---|
| 3,059,423 | 10/1962 | Berlyn | 60/312 |
| 3,174,583 | 3/1965 | Giordano | 181/252 |
| 4,523,662 | 6/1985 | Tanaka | 181/252 |

*Primary Examiner*—Douglas Hart

*Attorney, Agent, or Firm*—Birch, Stewart, Kolasch & Birch

[57] ABSTRACT

A straight through type muffler for generating an exhaust flow from an internal combustion engine includes a closed expansion chamber in communication with the straight through passage of the muffler. A minority of the gases passing through the straight through passage will be accumulated in the expansion chamber and will be returned to the straight through passage when the pressure of the gases passing through the straight through passage is reduced, thereby minimizing the back pressure from the muffler.

14 Claims, 4 Drawing Sheets

STRAIGHT THROUGH TYPE MUFFLER FOR GENERATING THE EXHAUST FLOW FROM AN INTERNAL COMBUSTION ENGINE

BACKGROUND OF THE INVENTION

The present invention relates to a muffler, and more particularly to a straight through type muffler for generating an exhaust flow from an internal combustion engine.

In order to reduce the noise of the combustion and exhaust of an internal combustion engine, exhaust gases from the engine are passed through a muffler. For an automotive vehicle, the muffler is interdisposed between an exhaust pipe and a tailpipe. Referring to FIG. 1, a conventional steel muffler for use in an automotive vehicle includes four resonance chambers in which the gases are expanded slowly, and four parallel porous ducts each of which is used to communicate with two of the resonance chambers at both ends thereof. The ducts form four flow-reversing bends to provide adequate noise control.

However, it is understood that there is a relatively large back pressure developed from this type of muffler. The back pressure prevents free flow of the exhaust gases from the engine and, as a result, not all of the burned gases will be exhausted from the cylinders. Such unexpelled gases dilute the incoming combustion gases so that engine power is reduced. In order to reduce the loss of the engine power, the mufflers are excluded from racing cars.

As is well known in the art, a straight through type muffler is used to reduce the loss of the engine power. Although the exhaust flow within the straight through type muffler is more smooth, its structure used for attenuating noise is only a blanket of sound-absorbing material lining the interior walls of a duct. The noise attenuating effect of the conventional straight through type muffler is not satisfactory.

SUMMARY OF THE INVENTION

It is therefore the main object of the present invention to provide a straight through type muffler for generating the exhaust flow from an internal combustion engine, which minimizes the back pressure therefrom.

It is the main feature of the present invention to provide a straight through type muffler with a closed expansion chamber means in communication with the straight through passage of the muffler, in which the minor part of the gases passing through the straight passage will be accumulated for being returned to the straight passage when the pressure of the gases passing through the straight passage is reduced, thereby minimizing the pressure drop in the straight passage of the muffler.

According to the present invention, the straight through type muffler includes a pipe having a straight exhaust main passage therein and a closed expansion chamber means in communication with an intermediate portion of the main passage so that the minor part of the gases passing through the main passage will flow into the expansion chamber means until the expansion chamber means is filled entirely with the gases, the amount of the gases flowing into the expansion chamber means being increased when the amount of the gases passing through the main passage is increased; thereby, when the expansion chamber means is filled with the gases from the main passage, so long as the amount of the gases passing through the main passage is reduced, it will be implemented partially from the gases filling in the expansion chamber means, thereby reducing the pressure drop in the main passage of the muffler.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

Other features and advantages of the present invenion wil become apparent from the following detailed description of the preferred embodiments of the present invention with reference to the accompanying drawings which are given by way of illustration only, and thus, are not limitative of the present invention, and in which.

DETAILED DESCRIPTION OF THE PREFERRED EMBODIMENTS

Figure 1:
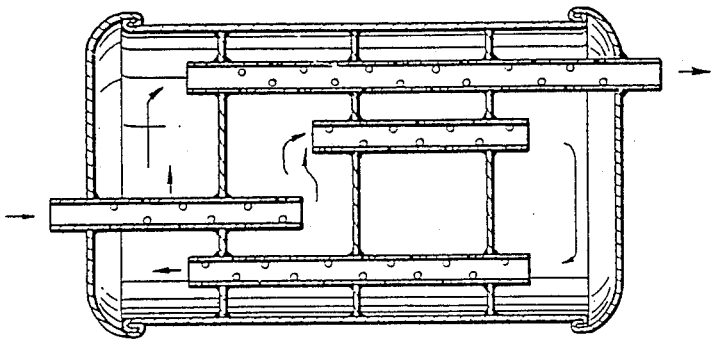
F I G. 1 PRIOR ART
FIG. 1 is a sectional view of a conventional muffler.
Figure 2:
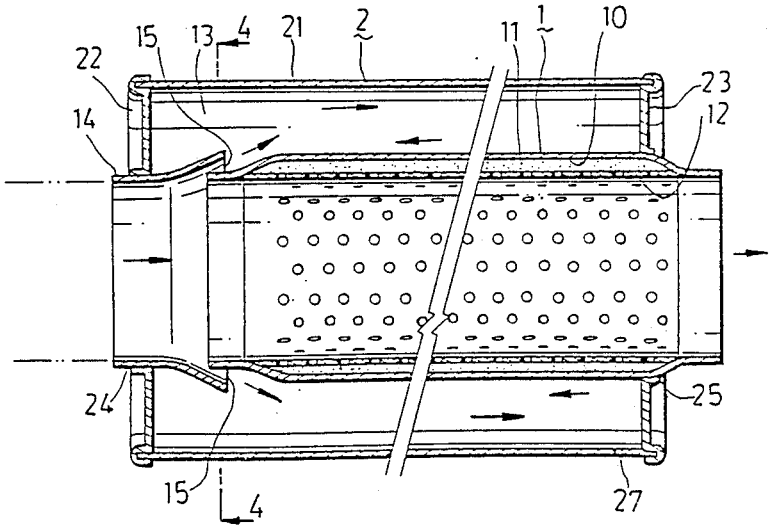
FIG. 2 is a sectional view of a straight through type muffler according to the first embodiment of the present invention.
Figure 3:
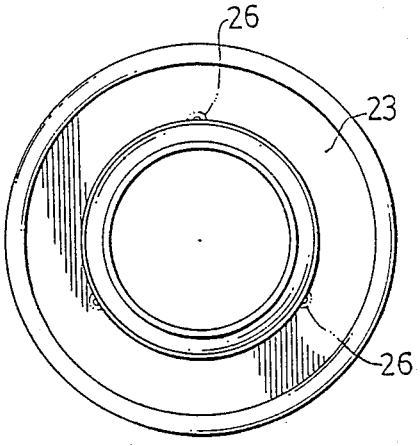
FIG. 3 is a rear view showing the straight through type muffler according to the first embodiment of the present invention.

Referring to FIGS. 2 and 3, there is shown a straight through type muffler according to the first embodiment of the present invention, which is used in an automotive vehicle. It includes a straight main pipe 1 and an expansion pipe 2 surrounding the main pipe 1. Lining the interior wall 10 of the main pipe 1 is a sound-absorbing material 11 such as glass fiber material which is used to absorb sound energy. When fabricated, the sound-absorbing material 11 is wound on a porous pipe 12. Then, the porous pipe 12 is inserted into the main pipe 1 both ends of which are subsequently compressed to hold the porous pipe 12 thereon.

The expansion pipe 2 includes a tubular shell 21 and two end plates 22 and 23 welded to the tubular shell 21. End plate 22 has a circular hole 24 at the center thereof. End plate 23 includes a circular hole 25 and three pressed circumferentially equally spaced notches 26 formed in the inner edge of the end plate 23 so that the main pipe 1 is conveniently inserted into the expansion pipe 2 through the circular hole 25. Then, the engagement portions between the end plates 22, 23 and the main pipe 1 are welded until the air tight effect is achieved. An annular expansion chamber 13 is thus formed between the expansion pipe 2 and the main pipe 1.

Figure 4:
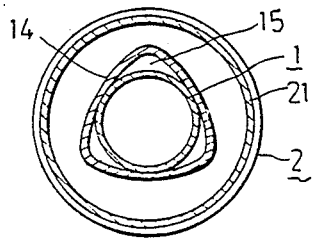
FIG. 4 is a sectional view taken along the line 4—4 of FIG. 2.

A fitting 14 having a pressed divergent triangular end portion (see FIG. 4) is provided for securing the front end of the main pipe 1 on the end plate 22 of the expansion pipe 2. The fitting 14 communicates with the exhaust pipe (not shown) of the internal combustion engine. After the fitting 14 is welded to the main pipe 1, three charging passages 15 to the expansion chamber 13 are formed. With the provision of the charging passages 15, the major part of the gases passing through the fitting 14 will flow into the main pipe 1 and the minor part of the gases passing through the fitting 14 will flow into the expansion chamber 13.

Figure 5:
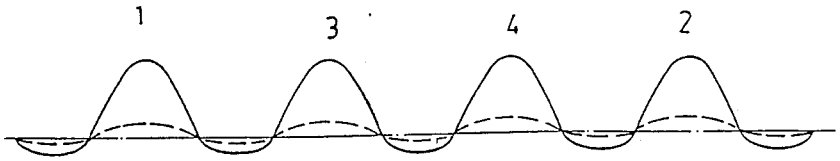
FIG. 5 is a pressure-to-time curve of the exhaust gases from a four-cylinder engine, in which the solid lines show that before passing through the muffler of the present invention and the phantom lines show that after passing through the muffler of the present invention.

Referring to FIG. 5, the pressure-to-time curve of the exhaust gases from a four-cylinder engine is shown in the solid lines. The exhaust order of the cylinders is 1-3-4-2 as shown. After one cylinder has exhausted and the next cylinder has not yet exhausted, the exhaust pressure is largely reduced so that the pneumatic hammer phenomenon takes place periodically, thereby making an extremely loud noise. When the pressure of the gases passing through the fitting 14 is at or near the peak value, the gases passing through the fitting 14 will be accumulated within the expansion chamber 13 so that the pressure is reduced, as shown by the phantom lines. When the pressure of the gases passing through the fitting 14 lowers, it is implemented from the gases from the expansion chamber 13 so that the pressure is increased, as shown by the phantom lines. Consequently, the pneumatic phenomena are diminished or eliminated so that the back pressure from the muffler is minimized. In other words, the loss of the engine power is minimized.

Again referring to FIG. 2, the expansion pipe 2 is provided with a small discharging hole 27. When the automotive vehicle is driven at a relatively high speed, the discharging hole 27 can be used to discharge the gases accumulated within the expansion chamber 13 so that the exhaust gases can flow smoothly.

Certainly, another blanket of sound-absorbing material (not shown) may be provided on the interior wall of the expansion pipe 2 to act as an additional dissipative device.

Figure 6:
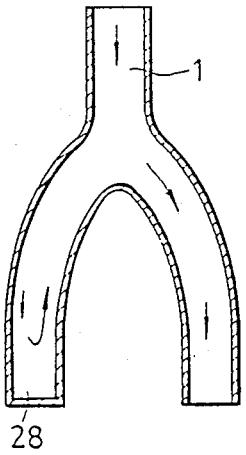
FIG. 6 is a sectional view showing a straight through type muffler according to the second embodiment of the present invention.

As a modification to the annular expansion chamber 13, referring to FIG. 6, a closed branch pipe 28 in communication with the main pipe 1 is provided. The volume of the closed branch pipe 28 is based on and proportional to the volume of the cylinders.

Figure 7:
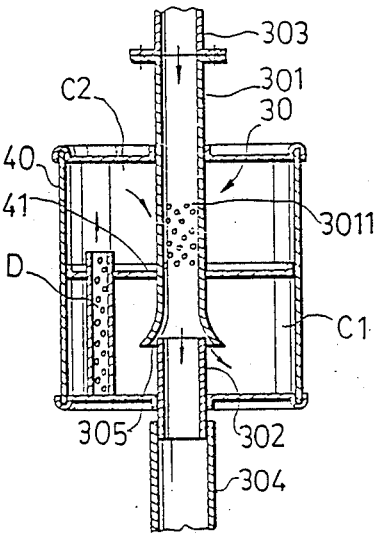
FIG. 7 is a sectional view of a straight through type muffler according to the third embodiment of the present invention.

Referring to FIG. 7, there is shown a straight through type muffler according to the third embodiment of the present invention. It includes a straight main pipe 30 and a surrounding expansion pipe 40 which is internally divided by a partition 41 into a first expansion chamber C1 and a second expansion chamber C2. The first expansion chamber C1 is positioned just behind the second expansion chamber C2. The main pipe 30 consists of a front tube 301 and a rear tube 302, which are interconnected with each other in a welding manner the same as that of the first embodiment. The front tube 301 is connected to the exhaust manifold 303. The rear pipe 302 is connected to the tailpipe 304. The main pipe 30 communicates with the first expansion chamber C1 by three charging passages 305 which are similar in construction to the charging passages 15 of the first embodiment. The first and second expansion chambers C1 and C2 are in communication with each other by a porous duct D positioned parallel to the main pipe 30. In addition, the front pipe 301 has a porous portion 3011 within the second expansion chamber C2.

When the engine runs at a low rotational speed ranging from about 600 to about 1,000 RPM, the first expansion chamber C1 is saturated with the gases from the front pipe 301 and subsequently returns the gases to the main pipe 30 when the exhaust pressure within the main pipe 30 is reduced. At this time, only a minor part of the second expansion chamber C2 is filled with the gases from the first expansion chamber C1. When the engine runs at a high rotational speed of more than 3,000 RPM, the gases can flow from the front pipe 301 to the first expansion chamber C1 thereby impelling the gases originally accumulated within the first expansion chamber C1 to flow into the second expansion chamber C2. When the exhaust pressure within the main pipe 30 is reduced, the gases accumulated within the first and the second expansion chambers C1 and C2 can return to the main pipe 30 through the charging passages 305 and the pores of the front pipe 301 respectively.

Figure 8:
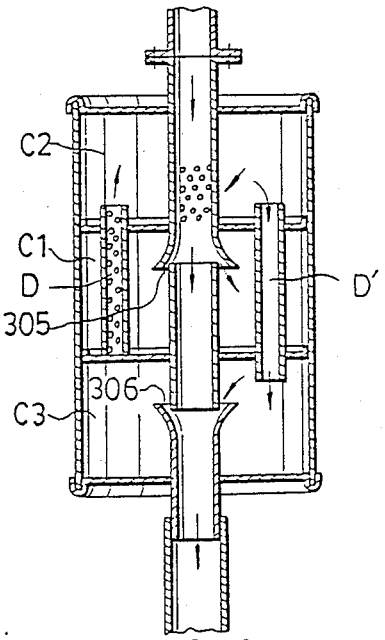
FIG. 8 is a sectional view of a straight through type muffler according to the fourth embodiment of the present invention.

Referring to FIG. 8, there is shown a straight through type muffler according to the fourth embodiment of the present invention. Unlike the third embodiment, it further has a third expansion chamber C3 which is positioned behind the first expansion chamber C1 within the expansion pipe 40. The third expansion chamber C3 communicates with the second expansion chamber C2 by another duct D' which is parallel to the main pipe 30. In addition, three discharging passages 306 are used to communicate the third expansion chamber C3 with the main pipe 1 behind the the charging passages 305. The discharging passages 306 are also similar to the charging passages 15 of the first embodiment in construction. Because the third expansion chamber C3 is provided, the engine can run fully at an extremely high rotational speed of more than about 5,000 RPM. When the third expansion chamber C3 is saturated with the gases from the second expansion chamber C2, the gases can be discharged from the third expansion chamber C3 through the discharging passages 306.

Figure 9:
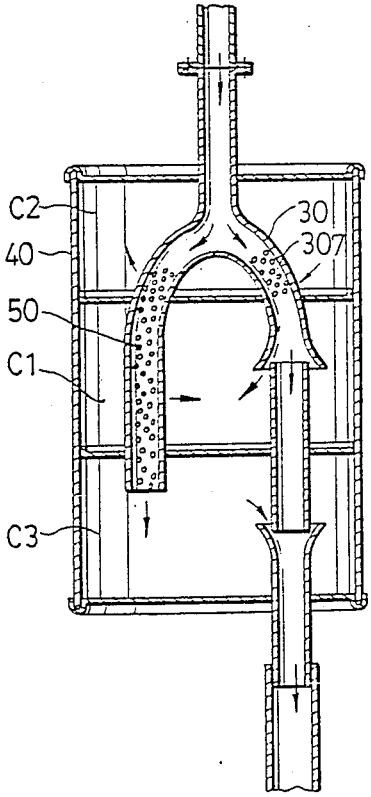
FIG. 9 is a sectional view of a straight through type muffler according to the fifth embodiment of the present invention.

Alternatively, referring to FIG. 9, the ducts D and D' of the fourth embodiment can be modified as a porous branch pipe 50 which communicates with the main pipe 30 and with the third expansion chamber C3. The porous portion of the branch pipe 50 is passed through the first expansion chamber C1 and the second expansion chamber C2. In addition, the main pipe 30 has a porous portion 307 within the second expansion chamber C2.

With the present invention thus explained, it is apparent that various modifications and variations can be made without departing from the scope and spirit of the present invention. It is therefore intended that the present invention be limited only as indicated in the appended claims.

What is claimed is:

1. A straight through type muffler for generating an exhaust flow from an internal combustion engine producing gases, said muffler comprising:

a pipe having an exhaust main passage therein, said pipe receiving the gases at a forward end thereof and exhausting gases at a rear end thereof;

closed expansion chamber means in communication with an intermediate portion of said main passage, said expansion chamber means receiving a minority of said gases passing through said main passage until said expansion means is filled with the gases; and at least one charging passage extending between the main passage and the expansion chamber means, said charging passage extending from the main passage at an angle thereto and extending in a direction toward the rear end of said pipe for enabling the minority of the gases passing through said main passage to readily be diverted to said expansion chamber means;

whereby, after said expansion chamber means is filled with the gases from said main passage and when the amount of the gases passing through said main passage is reduced, the gases in the main passage will be partially supplemented from the gases filling said expansion chamber means, thereby reducing pressure drop in said main passage of said muffler.

2. The muffler as claimed in claim 1, further comprising a blanket of sound-absorbing material lining the interior wall of said pipe.

3. The muffler as claimed in claim 1, wherein said expansion chamber means includes an annular expansion chamber surrounding said pipe.

4. The muffler as claimed in claim 3, wherein said pipe is porous so that said main passage communicates with said annular expansion chamber.

5. The muffler as claimed in claim 1, wherein said expansion chamber means includes a first expansion chamber in communication with said main passage, a second expansion chamber, and a first duct in communication with said first expansion chamber and with said second expansion chamber.

6. The muffler as claimed in claim 5, wherein said first expansion chamber is positioned just behind said second expansion chamber, and wherein the first duct is parallel to said main passage to form a flow-reversing bend of gas passage.

7. The muffler as claimed in claim 6, wherein said first duct is porous.

8. The muffler as claimed in claim 7, wherein each of said first and second expansion chambers is an annular chamber surrounding said pipe, and wherein said pipe has a porous portion within said second expansion chamber so that said main passage communicates with said second expansion chamber.

9. The muffler as claimed in claim 8, wherein a plurality of charging passages are provided extending rearwardly away from said pipe and in communication with said first expansion chamber and with said main passage.

10. The muffler as claimed in claim 9, wherein said expansion chamber means includes a third expansion chamber, and a second duct in communication with said second expansion chamber and with said third expansion chamber.

11. The muffler as claimed in clam 10, wherein said third expansion chamber is an annular chamber surrounding said pipe and positioned just behind said first expansion chamber to form another flow-reversing bend of gas passage.

12. The muffler as claimed in claim 11, wherein said third expansion chamber communicates with said main passage for discharging the gases from said third expansion chamber.

13. The muffler as claimed in claim 12, wherein said expansion chamber means includes a discharging passage extending forwardly away from said pipe and in communication with said main passage and with said third expansion chamber.

14. The muffler as claimed in claim 13, wherein said expansion chamber means includes a branch pipe in communication with said main passage at an end thereof and with said third expansion chamber at the opposite end of said branch pipe, said branch pipe having a porous portion parallel to said main passage and passing through said first and second expansion chambers to form both said first and second ducts so that any two of said first, second, and third expansion chambers are in communication with each other.

* * * * *